US007180025B2

(12) United States Patent
Kuwana et al.

(10) Patent No.: US 7,180,025 B2
(45) Date of Patent: Feb. 20, 2007

(54) PUSH SWITCH

(75) Inventors: Isamu Kuwana, Kawagoe (JP); Kouichi Sinzawa, Kawagoe (JP)

(73) Assignee: Kabushiki Kaisha T an T, Kawagoe (JP)

( * ) Notice: Subject to any disclaimer, the term of this patent is extended or adjusted under 35 U.S.C. 154(b) by 0 days.

(21) Appl. No.: 11/405,431

(22) Filed: Apr. 18, 2006

(65) Prior Publication Data

US 2006/0243576 A1 Nov. 2, 2006

(30) Foreign Application Priority Data

Apr. 28, 2005 (JP) ..... 2005-132641

(51) Int. Cl.
*H01H 13/14* (2006.01)

(52) U.S. Cl. ..... 200/520; 200/530; 200/341

(58) Field of Classification Search ..... 200/520, 200/530–536, 341
See application file for complete search history.

(56) References Cited

U.S. PATENT DOCUMENTS 5,878,870 A * 3/1999 Ohtaki ..... 200/314
5,973,284 A * 10/1999 Takenaka et al. ..... 200/532
6,326,570 B1 * 12/2001 Fujii et al. ..... 200/520
6,605,792 B2 * 8/2003 Sato ..... 200/524
6,861,602 B2 * 3/2005 Juga ..... 200/341

FOREIGN PATENT DOCUMENTS

JP 5-15249 2/1993
JP 5-23365 3/1993

* cited by examiner

*Primary Examiner*—Richard K. Lee
(74) *Attorney, Agent, or Firm*—Nixon & Vanderhye, P.C.

(57) ABSTRACT

A push-button switch includes a fixed member having a first fixed contact strip disposed on the inner surface of the fixed member and a second fixed contact strip disposed on the inner surface of the fixed member and opposite the first fixed contact strip; a control member biased by a spring from the fixed member and locked in a desired position; and a movable contact strip configured, when attached to the control member locked in the desired position, to be in contact with and to short-circuit the first fixed contact strip and the second fixed contact strip. The movable contact strip is configured to be isolated from the first and second fixed contact strips at substantially the same time when the control member is controlled against a biasing force of the spring.

3 Claims, 5 Drawing Sheets

PUSH SWITCH

BACKGROUND OF THE INVENTION

1. Field of the Invention

The present invention relates to a push-button switch turned on and off by opening and closing a vehicle door, configured to turn a vehicle interior light or the like on and off, and secured to a vehicle body.

2. Description of the Related Art

Examples of known push-button switches for turning an interior light on and off in response to the opening and closing of a vehicle door include those disclosed in Japanese Unexamined Utility Model Registration Application Publications Nos. 5-15249 and 5-23365. A push-button switch disclosed in either of these publications includes a fixed member having a first fixed contact strip (negative side) and a second fixed contact strip (positive side) that are internally disposed on opposite sides, a control member biased by a spring from the fixed member while allowing engaging claws thereof to be engaged with holes of the fixed member so as to prevent the control member from being protruded by the biasing force of the spring from a desired position in the fixed member, and a movable contact strip arranged inside the control member and electrically short-circuiting the first and second fixed contact strips while being biased by the spring.

In the push-button switch configured as described above, when a vehicle door is closed, the movable contact strip is held in contact with the second fixed contact strip, as the control member is pressed with a side portion of the door against the biasing force of the spring. However, since the movable contact strip is isolated from the first fixed contact strip, the push-button switch is turned off, which means that an interior light is turned off. When in this state the door is opened, the control member is protruded by the biasing force of the spring. This allows the movable contact strip to be positioned between the first and second fixed contact strips, the push-button switch to be turned on, and the interior light to be turned on.

In general, small vehicles are equipped with a 12-volt battery, while heavy vehicles and diesel vehicles are equipped with a 24-volt battery or a 42-volt battery. Recently, there is a move to incorporate a 24-volt battery also into small vehicles. This is because the use of a high-voltage battery enables the use of thin and small-capacity wires in a wire harness and thus contributes to reduced vehicle weight. However, while the use of a 12-volt battery poses no problem, the use of a battery of 24 volts or more in a vehicle with the above-described push-button switch poses some problems.

Specifically, it is known that when the battery voltage is 15 volts or higher and a push-button switch is turned off, a spark occurs between a movable contact strip and a fixed contact strip at the moment when the movable contact strip is isolated from the fixed contact strip. In the known push-button switch described above, a spark does not occur between the second fixed contact strip connected to the positive terminal of the battery and the movable contact strip, which are always slidably in contact with each other. However, a spark occurs between the first fixed contact strip and the movable contact strip, as the movable contact strip is isolated from the first fixed contact strip.

Such an occurrence of a spark causes darkening of a contact portion where the movable contact strip comes into contact with the first fixed contact strip, results in poor contact, and causes the first fixed contact strip and movable contact strip to be damaged, cut, and become unusable.

SUMMARY OF THE INVENTION

The present invention has been made in view of the problems described above, and an object thereof is to provide a push-button switch that causes sparks to occur at two different points by allowing a movable contact strip to be isolated from first and second fixed contact strips at substantially the same time, and thus reduces damages to contact portions and increases the service life of the contact strips.

According to a first aspect of the present invention, a push-button switch includes a fixed member having a first fixed contact strip disposed on the inner surface of the fixed member and a second fixed contact strip disposed on the inner surface of the fixed member and opposite the first fixed contact strip; a control member biased by a spring from the fixed member and locked in a desired position; and a movable contact strip configured, when attached to the control member locked in the desired position, to be in contact with and to short-circuit the first fixed contact strip and the second fixed contact strip. The movable contact strip is configured to be isolated from the first and second fixed contact strips at substantially the same time when the control member is controlled against a biasing force of the spring.

According to a second aspect of the present invention, the push-button switch of the first aspect further includes, in order to allow the movable contact strip to be isolated from the first and second fixed contact strips at substantially the same time, a nonconductive member embedded in an contact area of the second fixed contact strip, the contact area being in contact with the movable contact strip and extending downward from a level at which the movable contact strip is isolated from the first fixed contact strip.

According to a third aspect of the present invention, in the first aspect described above, in order to allow the movable contact strip to be isolated from the first and second fixed contact strips at substantially the same time, the second fixed contact strip has a long hole extending downward from a level at which the movable contact strip is isolated from the first fixed contact strip, so as to allow the movable contact strip to reach a nonconductive area.

According to a fourth aspect of the present invention, in the first aspect described above, in order to allow the movable contact strip to be isolated from the first and second fixed contact strips at substantially the same time, contact portions where the movable contact strip is in contact with the first and second fixed contact strips are removed from sliding surfaces of the respective first and second contact strips, the sliding surfaces along which the movable contact strip slides.

As described above, in the push-button switch of the present invention, in a transition from an ON state where the two fixed contact strips and the movable contact strip are in contact with each other, to an OFF state where the two fixed contact strips and the movable contact strip are separate from each other, the movable contact strip is isolated from the first and second fixed contact strips at substantially the same time. Since this allows sparks to occur at two different points, instead of at a single point, and can thus distribute the resulting damages, the service life of the contact strips can be increased.

DESCRIPTION OF THE PREFERRED EMBODIMENTS

A push-button switch of the present invention is configured such that a movable contact is isolated from first and second fixed contact strips at substantially the same time when a control member is controlled against a biasing force of a spring.

First Embodiment

Figure 1:
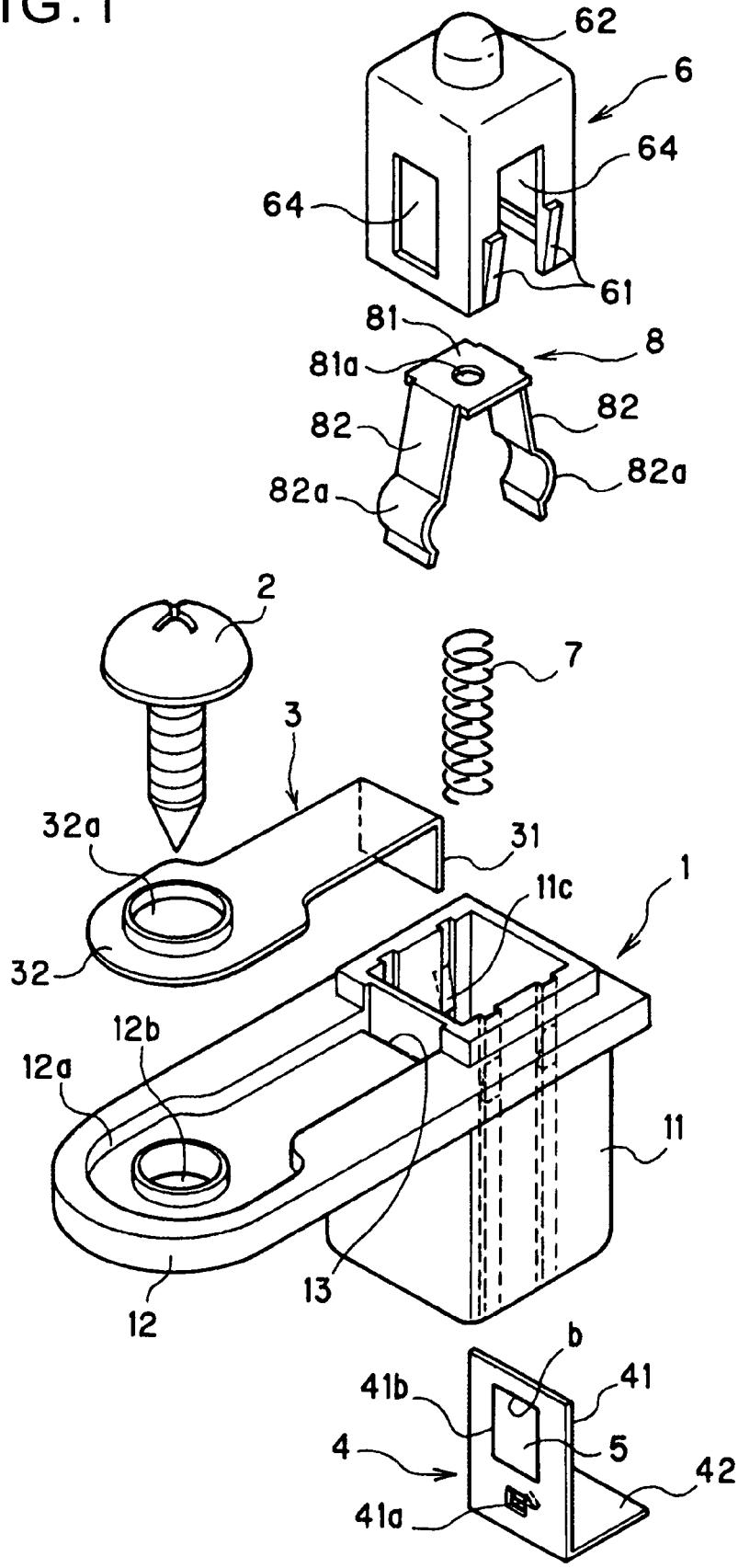
FIG. 1 is an exploded perspective view showing a push-button switch according to a first embodiment of the present invention.
Figure 2:
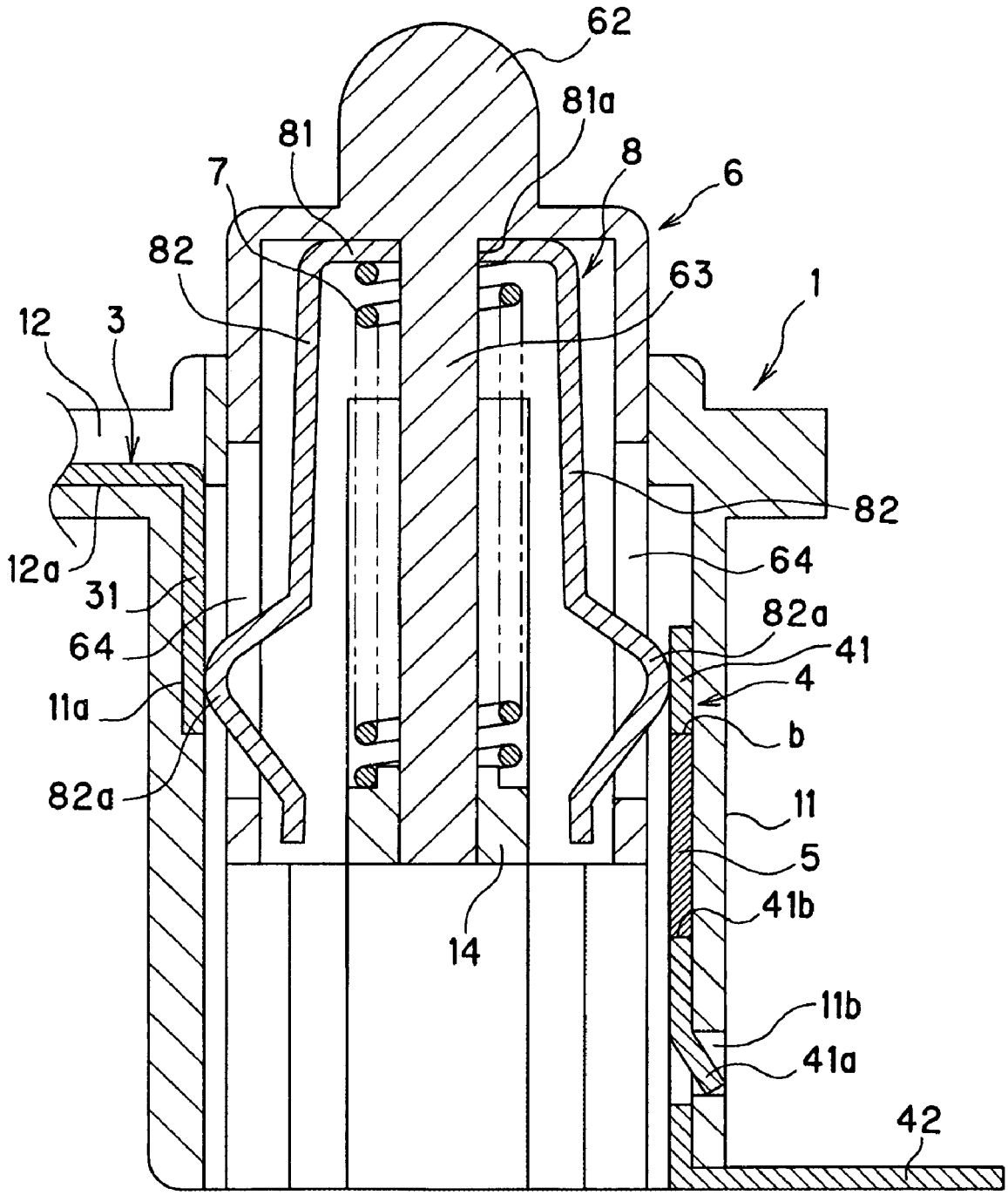
FIG. 2 is a cross-sectional view showing an ON state of the assembled push-button switch of FIG. 1.
Figure 3:
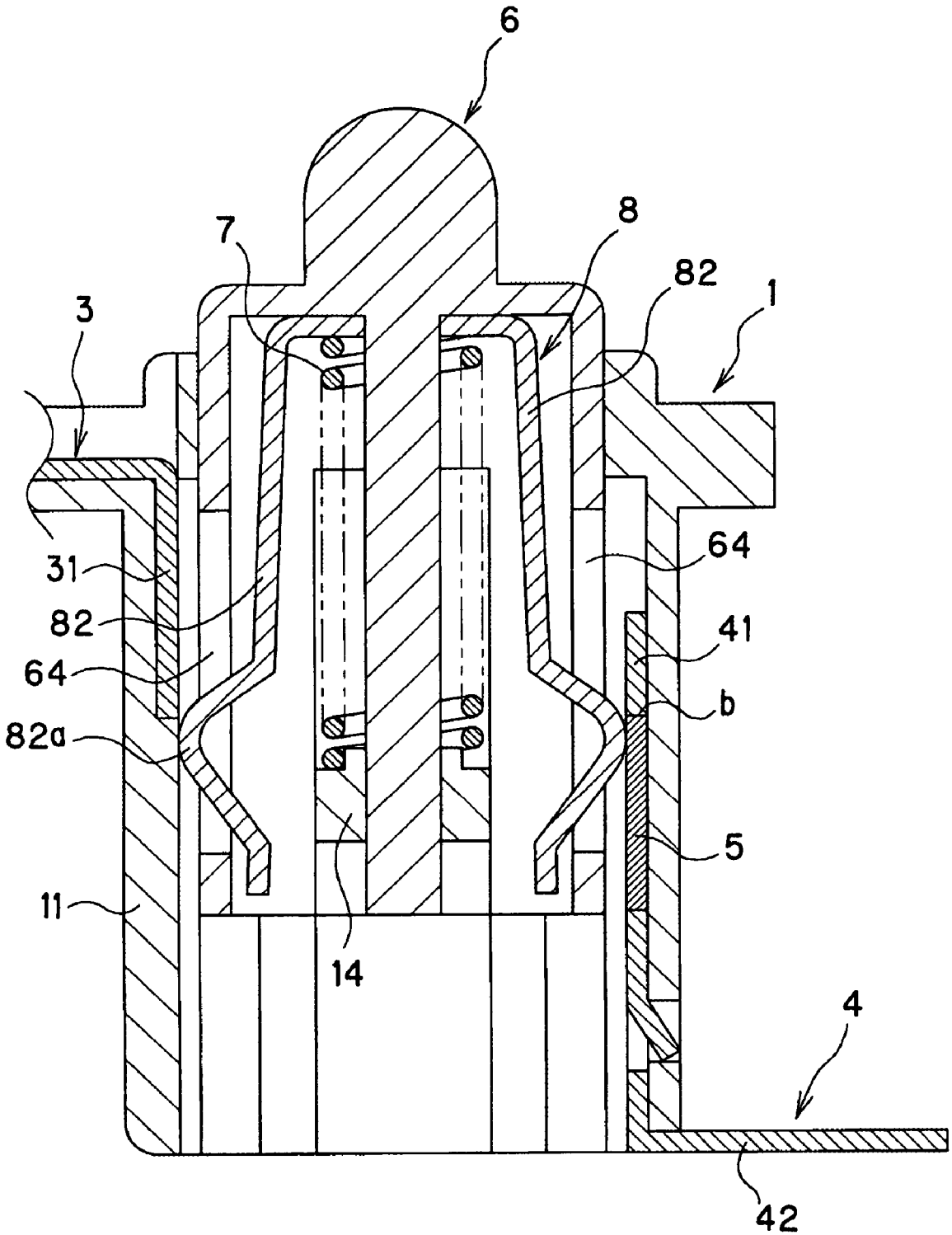
FIG. 3 is a cross-sectional view showing an OFF state of the assembled push-button switch of FIG. 1.

A push-button switch according to the first embodiment of the present invention will now be described with reference to FIGS. 1 through 3.

A fixed member 1 made of insulating material, such as resin, includes a rectangular housing 11 and a flange 12 horizontally extending from the housing 11. The flange 12 has a recessed portion 12*a* with a hole 12*b* for the insertion of a screw 2. A slot 13 is provided along the boundary between the housing 11 and the flange 12. Grooves 11*a* are provided inside the housing 11.

An L-shaped first fixed contact strip 3 includes a contact part 31 and a terminal part 32 with a hole 32*a* corresponding to the hole 12*b* in the recessed portion 12*a*. The contact part 31 is fitted in the grooves 11*a*, while the terminal part 32 is fitted in the recessed portion 12*a* of the fixed member 1. With the above-described configuration, the first fixed contact strip 3 is secured to the fixed member 1 while being secured with the screw 2 to a vehicle body and electrically connected to the ground of a battery.

Like the first fixed contact strip 3, an L-shaped second fixed contact strip 4 includes a contact part 41 and a terminal part 42. The contact part 41 has a bent engaging strip 41*a* to be engaged with a locking hole 11*b* in the fixed member 1. With the above-described configuration, the contact part 41 is secured to the inner surface of the housing 11 while being in contact therewith. Connecting a connector to the terminal part 42 allows electrical connection to an interior light or the like.

The contact part 41 of the second fixed contact strip 4 is provided with a long hole 41*b* in which a nonconductive member 5, such as a resin member, is embedded. A boundary "b" between the embedded nonconductive member 5 and the upper side of the long hole 41*b* is defined so as to be substantially level with the lower end of the first fixed contact strip 3.

A hollow control member 6 made of insulating material, such as resin, is to be slidably inserted into the housing 11 of the fixed member 1. Engaging claws 61 provided on the outer surface of the control member 6 are engaged with their corresponding engaging holes 11*c* on the inner surface of the housing 11 so that the control member 6 can be retained within the housing 11. The top of the control member 6 is provided with a protruding boss 62 to be pressed when a door is closed. A post 63 configured to be inserted into a spring 7 is integral with and extends downward from the protruding boss 62. The lower end of the post 63 is fitted in a hole of a spring bearing 14 inside the fixed member 1.

A U-shaped movable contact strip 8 is made of elastic conductive material and includes a base 81 and contact arms 82. The movable contact strip 8 is placed in the hollow of the control member 6 with the post 63 of the control member 6 fitted in a hole 81*a* of the base 81. After the post 63 is inserted into the spring 7, the control member 6 is inserted into the housing 11 of the fixed member 1. Since this allows the engaging claws 61 to be engaged with their corresponding engaging holes 11*c*, the control member 6 can be prevented from protruding from the housing 11 while being constantly biased upward by the spring 7.

Curved contact parts 82*a* extending from the contact arms 82 of the movable contact strip 8 are to be slidably in contact with the corresponding first and second fixed contact strips 3 and 4. The contact parts 82*a*, which are exposed through corresponding windows 64 to the sides of the control member 6, can come into contact with the first and second fixed contact strips 3 and 4.

The operation of the push-button switch configured as described above will now be described. In the state shown in FIG. 2, where the door is opened and no external force that presses the control member 6 is exerted thereon, the control member 6 is biased to a desired position (at which the engaging claws 61 are engaged with the engaging holes 11*c*) by a spring force of the spring 7. In this state, since the contact parts 82*a* of the movable contact strip 8 are in contact with the first and second fixed contact strips 3 and 4, a current flows from the second fixed contact strip 4 through the movable contact strip 8 to the first fixed contact strip 3. Therefore, an interior light connected to the second fixed contact strip 4 is turned on.

When the door is closed in this state, the control member 6 is pressed down with a side portion of the door against a spring force of the spring 7. This causes the contact parts 82*a* of the movable contact strip 8 to slide along the first and second fixed contact strips 3 and 4. Then, one of the contact parts 82*a* runs off the first fixed contact strip 3 and reaches the inner wall of the fixed member 1 while, at the same time, the other contact part 82*a* reaches the nonconductive member 5 of the second fixed contact strip 4. A spark occurs at a point which is first isolated from an insulating part.

Since there is a small clearance between the control member 6 and the housing 11, closing the door allows the control member 6 to move inside the housing 11 while being slightly inclined. In this case, of the two contact parts 82*a*, the one that has first been isolated from its corresponding fixed contact strip (3 or 4) cannot be identified. Therefore, of the first and second fixed contact strips 3 and 4, the one in which a spark occurs cannot be identified. Compared to the above-described known push-button switch where a spark occurs in one of two fixed contact strips, the likelihood of damage to contact portions can thus be reduced by half.

Second Embodiment

Figure 4:
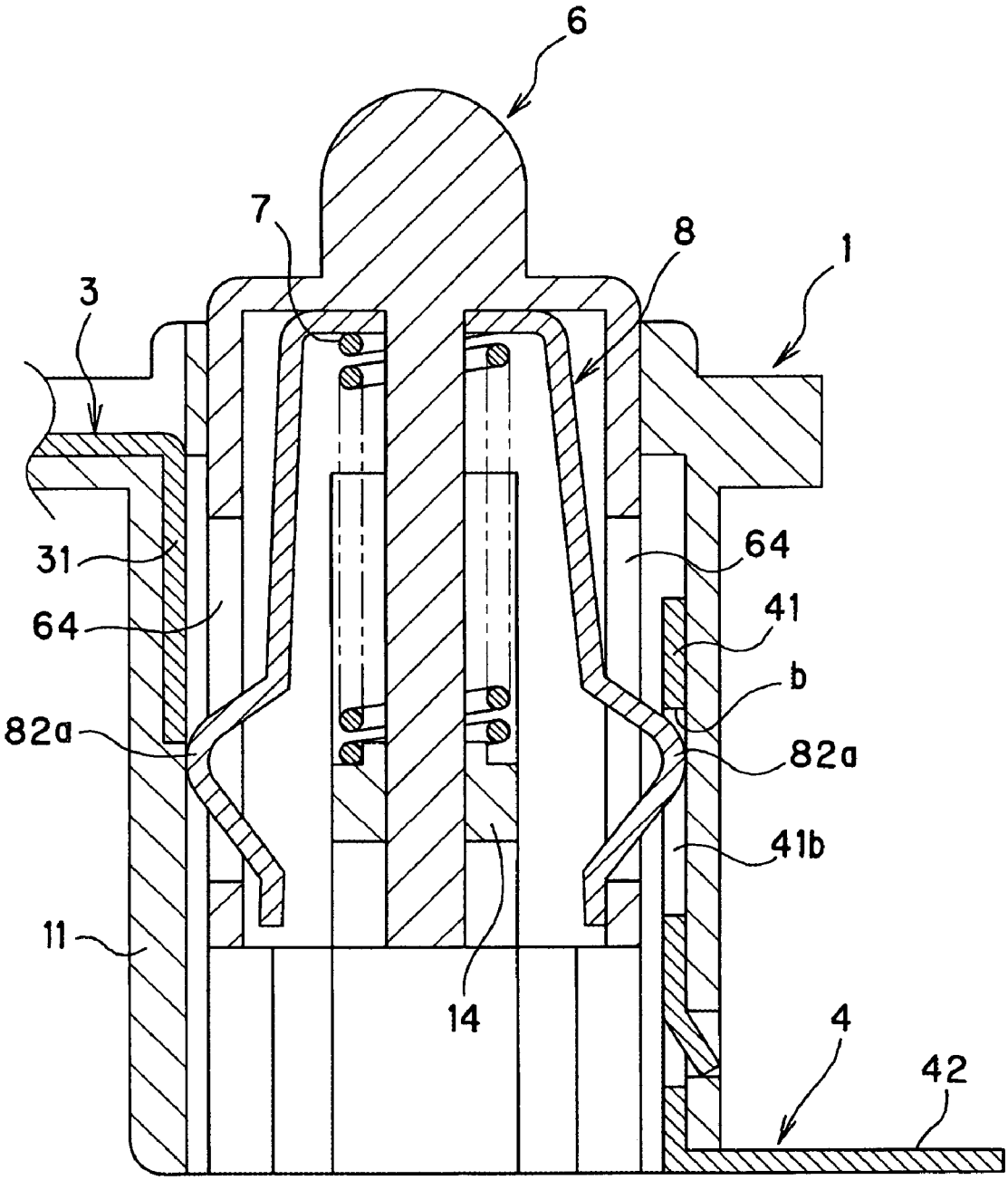
FIG. 4 is a cross-sectional view showing an OFF state of a push-button switch according to a second embodiment of the present invention.

A push-button switch of the second embodiment will now be described with reference to FIG. 4. The same reference numerals as those in the first embodiment denote the same or corresponding members and the descriptions thereof will be omitted here.

The second embodiment differs from the first embodiment in that the nonconductive member 5 is not embedded in the long hole 41*b* of the second fixed contact strip 4.

Like the first embodiment, in the second embodiment, closing the door moves the movable contact strip 8 downward, allows one of the contact parts 82*a* to be isolated from the first fixed contact strip 3 while at substantially the same time allowing the other contact part 82*a* to reach the long hole 41*b,* which is a nonconductive part of the second fixed contact strip 4. Thus, by a similar operation to that described above, damages resulting from the occurrence of sparks can be distributed to different contact portions and the service life of the contact strips can be increased.

Third Embodiment

Figure 5:
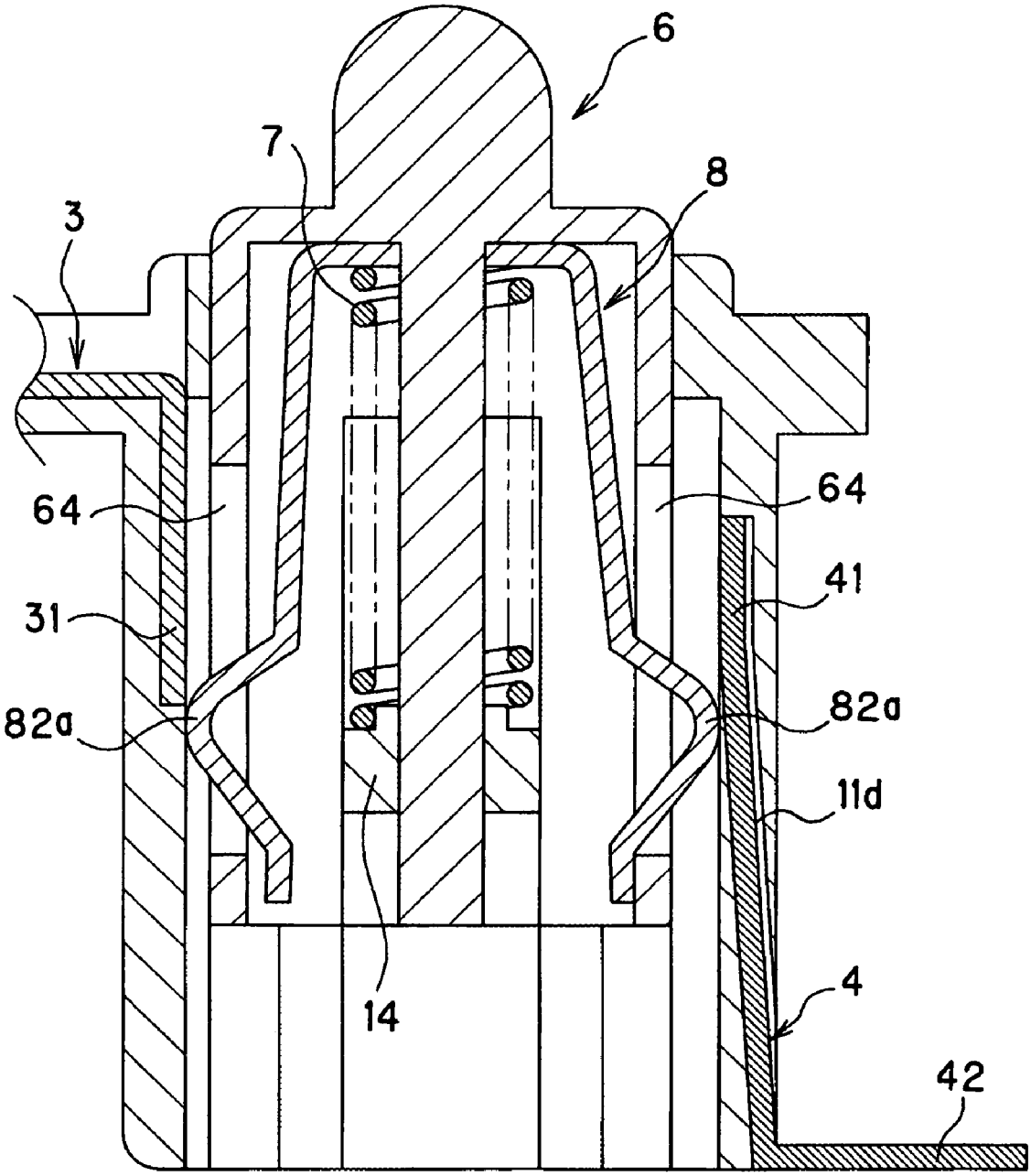
FIG. 5 is a cross-sectional view showing an OFF state of a push-button switch according to a third embodiment of the present invention.

A push-button switch of the third embodiment will now be described with reference to FIG. 5. The same reference numerals as those in the first and second embodiments denote the same or corresponding members and the descriptions thereof will be omitted here.

The third embodiment differs from the first and second embodiments in that the housing 11 is provided with a guide hole 11*d* for accommodating the contact part 41 of the second fixed contact strip 4. The contact part 41 is inserted from the bottom of the guide hole 11*d* such that the lower end of an exposed portion of the contact part 41, the exposed portion being exposed to the inner surface of the housing 11, is positioned at substantially the same level as the lower end of the contact part 31 of the first fixed contact strip 3. Thus, the contact parts 82*a* of the movable contact strip 8 are isolated from their corresponding first and second fixed contact strips 3 and 4 at substantially the same level.

Similar to the first and second embodiments described above, in the third embodiment, when the door is closed and the movable contact strip 8 moves downward, the contact parts 82*a* are isolated from their corresponding first and second fixed contact strips 3 and 4 at substantially the same time. Therefore, by a similar operation to that described above, damages resulting from the occurrence of sparks can be distributed to different contact portions and the service life of the contact strips can be increased.

While each of the above-described embodiments refers to the case where the present invention is applied to a door switch, the present invention is also applicable to push-button switches used in other parts of vehicles.

What is claimed is:

1. A push-button switch comprising:

a fixed member including a first fixed contact strip disposed on the inner surface of the fixed member; a second fixed contact strip disposed on the inner surface of the fixed member and opposite the first fixed contact strip; and a spring;

a control member biased by the spring from the fixed member and locked in a desired position; and a movable contact strip configured, when attached to the control member locked in the desired position, to be in contact with and to short-circuit the first fixed contact strip and the second fixed contact strip, wherein the movable contact strip is configured to be isolated from the first and second fixed contact strips at substantially the same time when the control member is controlled against a biasing force of the spring, and wherein in order to allow the movable contact strip to be isolated from the first and second fixed contact strips at substantially the same time, the push button switch further comprises a nonconductive member embedded in a contact area of the second fixed contact strip, the contact area being in contact with the movable contact strip and extending downward from a level at which the movable contact strip is isolated from the first fixed contact strip.

2. A push-button switch comprising:

a fixed member including a first fixed contact strip disposed on the inner surface of the fixed member, a second fixed contact strip disposed on the inner surface of the fixed member and opposite the first fixed contact strip, and a spring;

a control member biased by the spring from the fixed member and locked in a desired position; and a movable contact strip configured, when attached to the control member locked in the desired position, to be in contact with and to short-circuit the first fixed contact strip and the second fixed contact strip, wherein the movable contact strip is configured to be isolated from the first and second fixed contact strips at substantially the same time when the control member is controlled against a biasing force of the spring, and wherein in order to allow the movable contact strip to be isolated from the first and second fixed contact strips at substantially the same time, the second fixed contact strip has a long hole extending downward from a level at which the movable contact strip is isolated from the first fixed contact strip, so as to allow the movable contact strip to reach a nonconductive area.

3. The push-button switch according to claim 1 or claim 2, wherein, in order to allow the movable contact strip to be isolated from the first and second fixed contact strips at substantially the same time, contact portions where the movable contact strip is in contact with the first and second fixed contact strips are removed from sliding surfaces of the respective first and second contact strips, the sliding surfaces along which the movable contact strip slides.

* * * * *